US007094073B2

(12) United States Patent
Obata et al.

(10) Patent No.: US 7,094,073 B2
(45) Date of Patent: Aug. 22, 2006

(54) RELAY CONNECTION CIRCUIT AND RELAY CONNECTOR

(75) Inventors: Hiroyuki Obata, Yokohama (JP); Taketaro Doi, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/853,720

(22) Filed: May 26, 2004

(65) Prior Publication Data

US 2005/0003702 A1 Jan. 6, 2005

(30) Foreign Application Priority Data

May 30, 2003 (JP) ..... 2003-155436

(51) Int. Cl.
*H01R 12/00* (2006.01)

(52) U.S. Cl. ..... 439/76.2; 439/507

(58) Field of Classification Search ..... 439/76.2, 439/680, 924.1, 507–514
See application file for complete search history.

(56) References Cited

U.S. PATENT DOCUMENTS 6,309,244 B1 10/2001 Gundermann et al. ..... 439/507
6,447,340 B1 * 9/2002 Wu ..... 439/660
6,699,049 B1 * 3/2004 Wu ..... 439/79
6,790,067 B1 * 9/2004 Douty et al. ..... 439/284
6,887,084 B1 * 5/2005 Saito et al. ..... 439/76.2

FOREIGN PATENT DOCUMENTS

FR 2 764 445 12/1998
JP 9-115626 5/1997

* cited by examiner

*Primary Examiner*—Gary F. Paumen
(74) *Attorney, Agent, or Firm*—Armstrong, Kratz, Quintos, Hanson & Brocks, LLP

(57) ABSTRACT

A relay connector with a reduced number of connection lines leading out from one side of the relay connector, which includes a plurality of branch connectors equipped with first and second connection terminals, and a main-body connector where common contacts reside in a housing, in which a third connection terminal connected to the common contacts and a fourth connection terminal connected to the second connection terminals are installed in the housing, the common contacts and the third connection terminal being connected, and the common contacts are connected to the first connection terminal of each branch connector and the second connection terminals are connected to the fourth connection terminal when coupling the main-body connector and the branch connectors.

13 Claims, 12 Drawing Sheets

(c)

(a)

(b)

(a)

(b)

(c)

(a)

(b)

RELAY CONNECTION CIRCUIT AND RELAY CONNECTOR

BACKGROUND OF THE INVENTION

1. Field of the Invention

The present invention relates to a relay connection circuit and a relay connector, in particular to a relay connection circuit and a relay connector with a reduced number of connection lines leading out from one side of the relay connector.

2. Description of the Related Art

In various kinds of machine tools, several sensors are installed around them which transmit certain signals to perform different modes of control operation.

In the case of the present invention, a plurality of power supply lines (hereinafter referred to as "Power Line") and signal lines are connected between substrate connectors and sensors in a particular machine tool in order to supply electric power to the sensors. In recent years, the number of power lines and signal lines installed has increased as machine tools and the like have become multifunctional.

FIG. 12 shows a known connection circuit of power lines and signal lines between a machine tool and a plurality of sensors, wherein FIGS. 12(*a*) and (*b*) respectively show examples of two different connection circuits.

In the connection circuit 100A shown in FIG. 12(*a*), a substrate connector 102A provided in the machine tool consists of a plug-type connector 102*a* and a socket-type connector 102*b*, power lines $\mathbf{103}_1$ to $\mathbf{103}_8$ and signal lines $\mathbf{104}_1$ to $\mathbf{104}_8$ which are severally connected to the plug-type connector 102*a*, and the tips of the said power lines and signal lines are connected to a plurality of sensors (S1 to S8).

In this connection circuit, the 8 sensors S1 to S8, to which 2 power lines and 1 signal line are respectively connected, are in turn connected to the substrate connector 102A, and each of the plug-type connector 102*a* and the socket-type connector 102*b* of the substrate connector 102A requires 24 contacts. On the other hand, 16 power lines and 8 signal lines are required between sensors S1 to S8 and the plug-type connector 102*a*.

There may be more than one signal line but if the number of sensors is increased, the number of signal lines will increase in proportion to the increase in the number of sensors, and in such an event the size of the substrate connector must be enlarged accordingly.

In the connection circuit 100B shown in FIG. 12(*b*), relay connectors $\mathbf{105}_1$ to $\mathbf{105}_8$ are provided between sensors S1 to S8 and a substrate connector 102B. The same number of power lines and signal lines as that of connection circuit 100A is required in this connection circuit.

Japanese Laid-Open Patent Publication No. 9-115626 (FIG. 7, left column on page 4) describes an electric circuit using branch connectors in which crossover wiring is disposed.

The electric circuit uses branch connectors where a flat plate branch conductor, in which a plurality of first and second tab contacts are severally formed on both sides of a strip-shaped common conductor part (crossover wiring) is disposed, and the power lines and a number of electric components are connected to the first tab contacts and the second tab contacts, respectively.

According to this electric circuit, electric power can be distributed from the power lines to several electric components via the common conductors.

However, because the known connection circuit utilizes a large number of power lines, the number of contacts of the substrate connector accordingly becomes larger, thereby requiring a large-sized connector. Considering that machine tools and the like have increasingly become smaller and multifunctional, such that several components and wirings connecting the components are intricately stretched, conceptualizing a design to provide space for mounting a large-sized connector has become difficult.

Even using the branch connectors described in Japanese Laid-Open Patent Publication No. 9-115626 cannot solve this problem. Because the branch connectors form a branch connection circuit by disposing the crossover wiring in a connector housing, a connection circuit of different connection lines, particularly power lines and signal lines, cannot be established.

SUMMARY OF THE INVENTION

The present invention aims to solve the abovementioned problem and provides a relay connection circuit with a reduced number of connection lines leading out from one side of a relay connector and thereby facilitate the circuit design for peripheral devices.

The present invention also provides a relay connector with a reduced number of connection lines leading out from one side of the relay connector.

The relay connection circuit of the present invention has common contacts residing in a housing and is disposed between the substrate connector installed in the main equipment and the like and a plurality of pieces of sub-equipment, the relay connector and the pieces of sub-equipment being connected by the first and second connection lines of each sub-equipment, the first connection lines being severally connected to the common contacts, and the common contacts and the second connection lines are connected to the substrate connector.

The common contacts may be connected to the substrate connector by connecting a short-circuit connector to the relay connector.

According to the relay connection circuit of the present invention, the first connection lines are connected to the common contacts and the common contacts and the second connection lines are connected to the substrate connector, so that the number of connection lines leading out from the relay connector can be reduced. In addition, because the common contacts are connected to the substrate connector by linking the short-circuit connector to the relay connector, the circuit can be disconnected/connected by attaching/detaching the short-circuit connector. Further, different types of connection lines, such as power lines and signal lines, are used as the first and second connection lines to form the connection circuit.

Furthermore, the relay connector of the present invention comprises a plurality of branch connectors equipped with first and second connection terminals and a main-body connector where the common contacts are disposed in a housing, in which a third connection terminal connected to the common contacts and a fourth connection terminal connected to the second connection terminal are installed in the housing, the common contacts and the third connection terminal being connected, and the common contacts are connected to the first connection terminal of each branch connector while the second connection terminal is connected to the fourth connection terminal when coupling the main-body connector and the branch connectors.

According to the relay connector of the present invention, the number of connection lines leading out from one side of the main-body connector can be reduced.

The common contacts may be substantially formed in a comb-shape such that several tab contacts bristle from a strip-shaped plate base with a predetermined width. Alternatively, the common contacts are disposed in the main-body connector housing substantially parallel to the longitudinal direction of the main-body connector.

Further, the common contacts may comprise a pair of common contacts having the same shape, in which one common contact is bent from the base, and the tab contact tips of one common contact are shorter than those of the other common contact when they reside in the main-body connector housing, while the common contacts and the third connection terminal are connected by the short-circuit connector, and the short-circuit connector is installed freely so as to be detachable from the front wall of the main-body connector.

When the common contacts are used, common contacts having different shapes can be formed by bending one type of common contact. Furthermore, because the short-circuit connector is installed freely so as to be detachable from the front wall of the main-body connector, the short-circuit connector is easily attached/detached. Further, the electric circuit is disconnected/connected by attaching/detaching the short-circuit connector.

Further still, it is preferable that the branch connectors are aligned with the opening of the main-body connector housing and equipped with alignment means on each housing peripheral wall and are installed freely so as to be detachable. Because the branch connectors are provided with individual alignment means, erroneous installation thereof is avoided.

BRIEF DESCRIPTION OF THE DRAWINGS

FIG. 10(*e*) shows the external perspective view of a power source terminal, while FIG. 10(*f*) shows the external perspective view of a signal terminal.

DETAILED DESCRIPTION OF EXEMPLARY EMBODIMENTS OF THE INVENTION

The exemplary embodiments of the present invention will be described hereafter with reference to the drawings. Note that the present invention is not limited to the embodiments described below.

Figure 1:
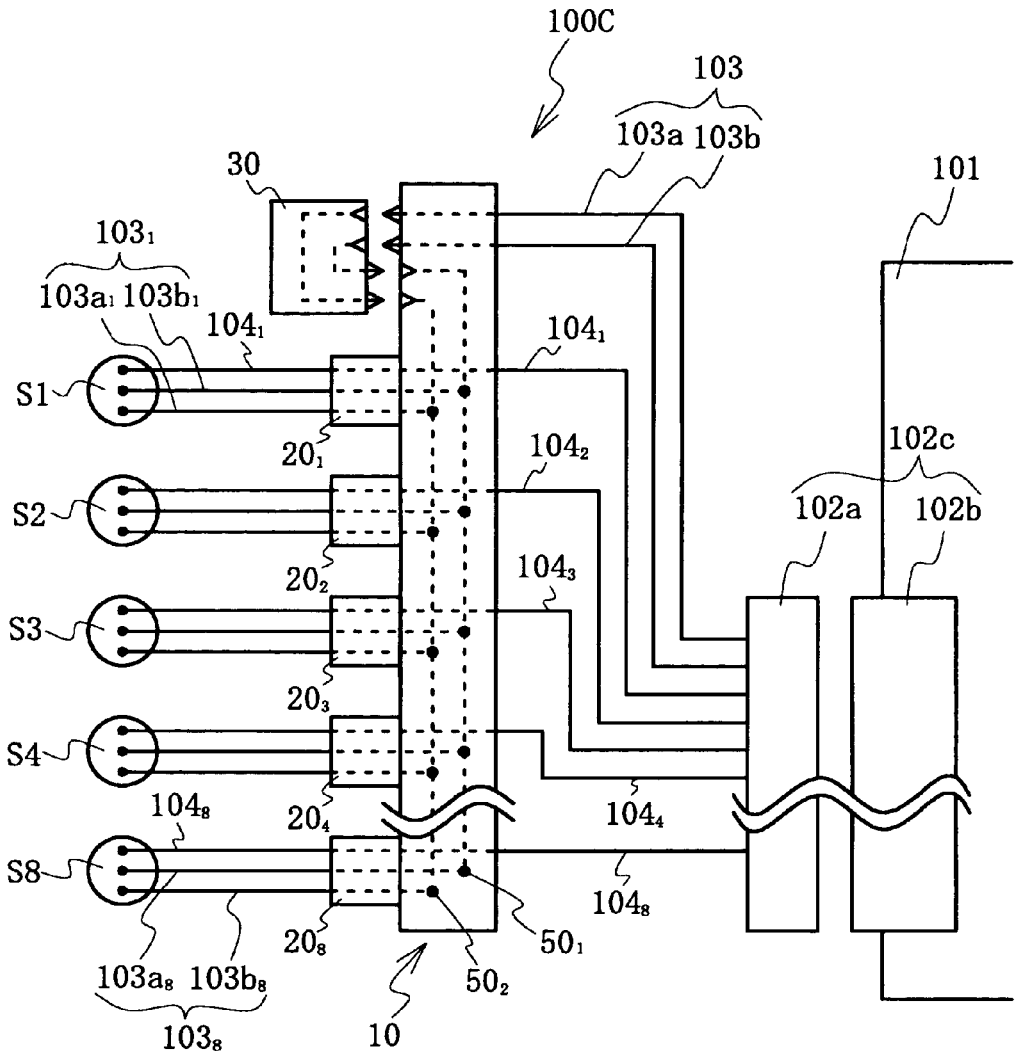
FIG. 1 is a circuit diagram showing the relay connection circuit of the present invention.

FIG. 1 is a circuit diagram showing the relay connection circuit of the present invention.

The connection circuit 100C supplies electric power from a substrate connector 102*c* to a plurality of equipment such as sensors S1 to S8, and receives signals by using a relay connector 10.

In the relay connector 10, one peripheral side thereof is connected to the substrate connector 102*c* via a power line 103 and signal lines $\mathbf{104}_1$ to $\mathbf{104}_8$, while the branch connectors $\mathbf{20}_1$ to $\mathbf{20}_8$ are attached to the other peripheral side and connected to the sensors S1 to S8 via power lines $\mathbf{103}_1$ to $\mathbf{103}_8$ and the signal lines $\mathbf{104}_1$ to $\mathbf{104}_8$.

Common contacts $\mathbf{50}_1$, $\mathbf{50}_2$ are disposed in the relay connector 10, and the power lines $\mathbf{103}_1$ to $\mathbf{103}_8$ of sensors S1 to S8 are severally connected to the common contacts $\mathbf{50}_1$, $\mathbf{50}_2$. The common contacts $\mathbf{50}_1$, $\mathbf{50}_2$ are connected to two power lines 103*a*, 103*b* by coupling a short-circuit connector 30, and connected to the substrate connector 102*c*. The relay connector 10 and the substrate connector 102*c* are connected via signal lines $\mathbf{104}_1$ to $\mathbf{104}_8$.

According to the connection circuit ϕC, the power lines $\mathbf{103}_1$ to $\mathbf{103}_8$ corresponding to the sensors S1 to S8 are severally connected to the common contacts $\mathbf{50}_1$, $\mathbf{50}_2$ and the common contacts $5O_1$, $\mathbf{50}_2$ are connected to the substrate connector 102*c*, such that there are two (2) power lines between the relay connector 10 and the substrate connector 102*c*. Thus, in contrast to the number of power lines used in the connection circuit of the prior art, the number of power lines has been reduced from 16 to 2. Further, because the number of contacts of the substrate connector has been reduced from 24, which has been conventionally needed, to 10, a smaller substrate connector can be used and substantial substrate space can be saved, thereby facilitating circuit design.

Note that the number of power lines and signal lines is not restricted to the above-mentioned number, because any number can be selected according to the design of the circuit. In other words, it is possible to reduce the number of power lines between the relay connector and the substrate connector by the relay connection circuit even if an arbitrary selection is made.

Figure 2:
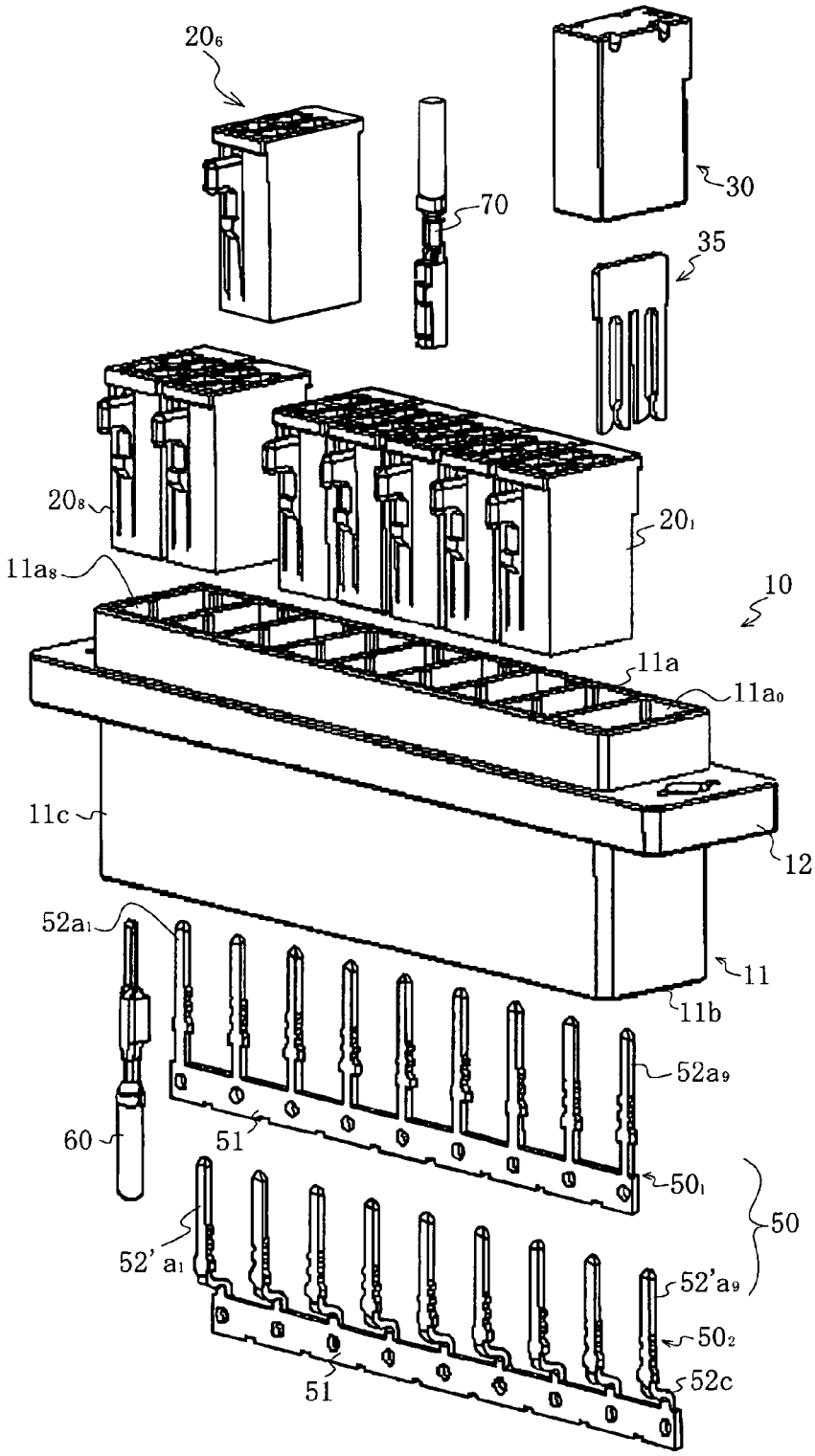
FIG. 2 is an exploded perspective view showing the relay connector of the present invention.

FIG. 2 is the exploded perspective view showing the relay connector of the present invention.

The relay connector 10 essentially consists of a main-body connector 11, a plurality of branch connectors $\mathbf{20}_1$ to $\mathbf{20}_8$ and the short-circuit connector 30 which are attached to the front wall 11*a* of the main-body connector 11, and common contacts 50 and a connection terminal 60 which are attached to a rear wall 11*b*.

The main-body connector 11 is made of a long rectangular solid housing, where a plurality of openings $\mathbf{11}a_0$ to $\mathbf{11}a_8$ are formed on its front wall 11$a$ along a longitudinal direction, and the branch connectors 20$_1$ to 20$_8$ and the short-circuit connector 30 are inserted into the openings 11$a_0$ to 11$a_8$.

Small openings are respectively formed in the housing of each of the branch connectors 20$_1$ to 20$_8$ and the short-circuit connector 30, and connection terminals 70 are attached to the small openings. Specifically, three connection terminals 70 (FIG. 2 shows only one) are respectively installed in each of the branch connectors 20$_1$ to 20$_8$. Two of the three connection terminals are used as power source terminals and the remaining one is used as a signal terminal. Further, short-circuit contacts 35 are installed in the short-circuit connector 30.

Two concave grooves and a plurality of small openings are formed on the rear wall 11$b$ of the main-body connector 11 along a longitudinal direction, and the common contacts 50 and connection terminals 60 (FIG. 2 shows only one) are respectively installed in the concave grooves and the small openings. The connection terminals 60 are the power source terminals and the signal terminal (hereafter described).

Next, each component comprising the relay connector will be described in detail.

Figure 3:
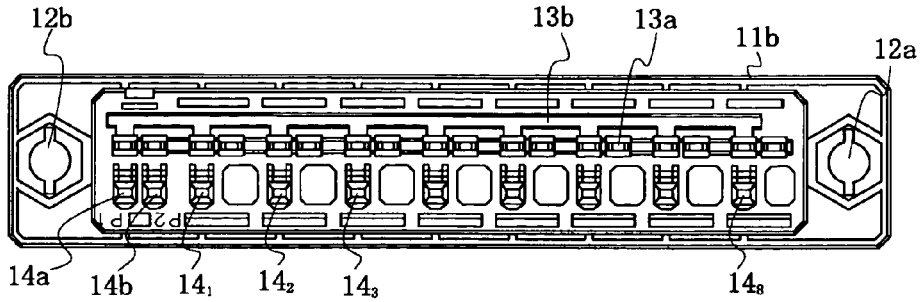
FIG. 3 shows a main-body connector, in which FIGS. 3(*a*), (*b*) and (*c*) respectively show the plane, front and back views thereof.
Figure 3:
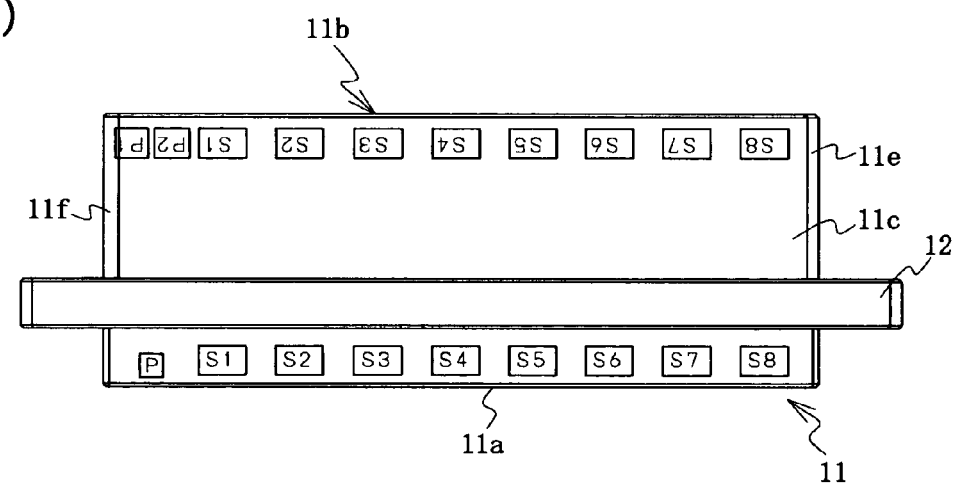
Figure 3:
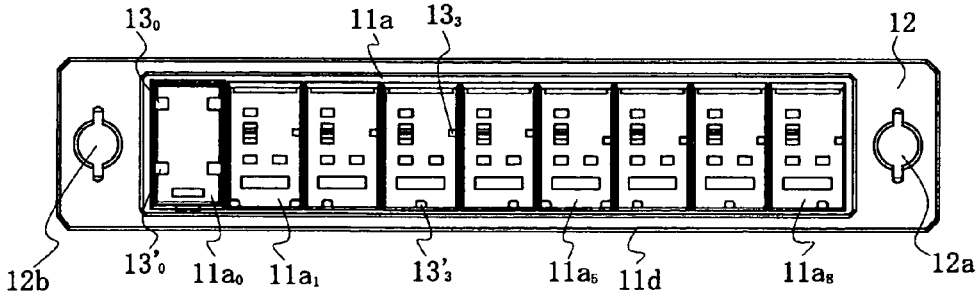

FIG. 3 shows the main-body connector, in which FIGS. 3($a$), ($b$) and ($c$) respectively show the plane, front and back views thereof.

Made of a synthetic resin material, the main-body connector 11 consists of a long rectangular solid housing having a front wall 11$a$, a rear wall 11$b$, an upper wall 11$c$, a bottom wall 11$d$, a right wall 11$e$ and a left wall 11$f$. A flange 12 of a predetermined width protruding near the front wall 11$a$ is formed on the periphery of the housing, and attachment holes 12$a$, 12$b$ for installing equipment are formed on both end portions of the flange 12. Further, the upper wall 11$c$ of the main-body connector 11 is marked with reference numerals indicating the position of the branch connectors 20$_1$ to 20$_8$, the short-circuit connector 30 and the connection terminals 60, 70 to be installed. The reference numeral P represents the short-circuit connector, while P1 and P2 stand for the power source terminals and S1 to S8 represent the branch connectors or the signal terminal.

A plurality of openings 11$a_0$ to 11$a_8$, into which the branch connectors 20$_1$ to 20$_8$ and one short-circuit connector 30 are inserted, are formed on the front wall 11$a$ of the main-body connector. The short-circuit connector 30 is inserted into the opening 11$a_0$ at the far left, and the branch connectors 20$_1$ to 20$_8$ are inserted severally into the other openings 11$a_1$ to 11$a_8$. To prevent the branch connectors from being erroneously inserted into openings other than their designated locations, alignment protrusions are formed inside each of the openings 11$a_0$ to 11$a_8$. For example, linear ribs 13$_0$, 13'$_0$ are formed on both inner walls in the case of the opening 11$a_0$. Similarly, ribs are respectively formed in the other openings in different positions. For example, ribs 13$_3$, 13'$_3$ are formed in the opening 11$a_3$.

Figure 11:
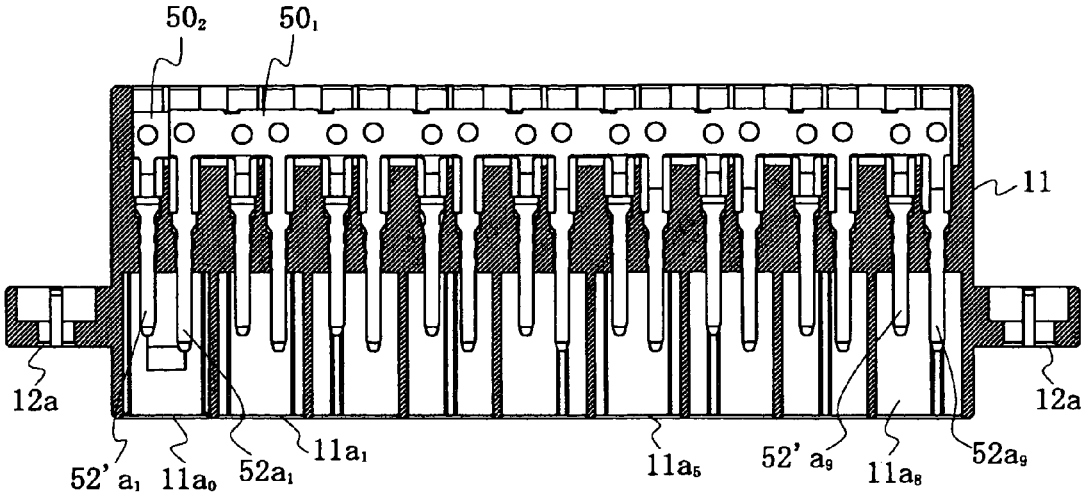
FIG. 11 is a sectional view of FIG. 9(*c*), which is the back view of the relay connector.
Figure 12:
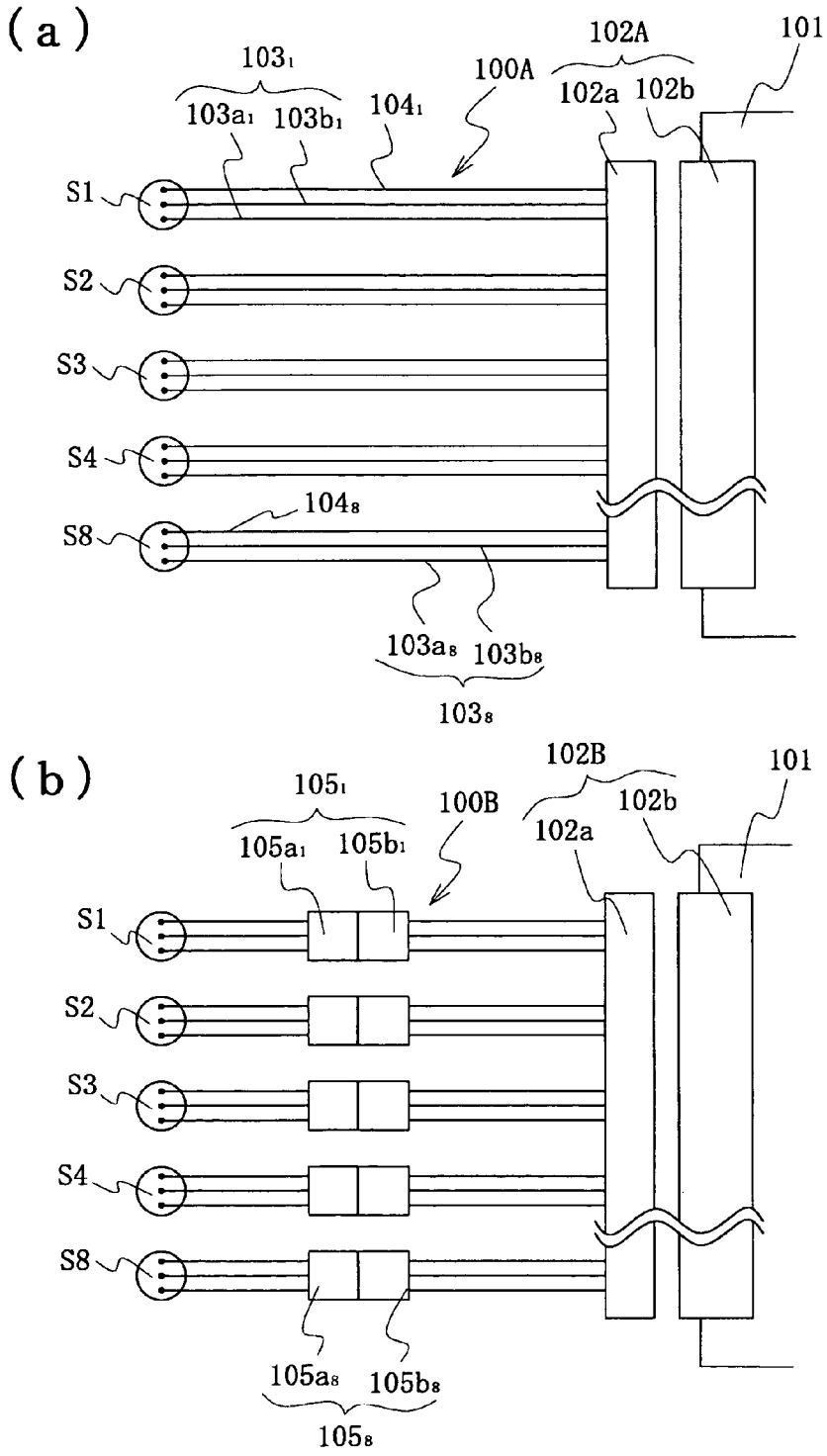
FIG. 12 shows a connection circuit of power lines and signal lines between a machine tool and a plurality of sensors, in which FIGS. 12(*a*) and (*b*) respectively show examples of two (2) connection circuits.

Two concave grooves 13$a$, 13$b$ and a plurality of small openings 14$a$, 14$b$, 14$_1$ to 14$_8$ are formed on the rear wall 11$b$ of the main-body connector 11. Common contacts 50$_1$, 50$_2$ are respectively installed in each of the concave grooves 13$a$, 13$b$ (refer to FIG. 2). Further, the power source terminals 60 (marked by reference numerals P1 and P2) are inserted into the small openings 14$a$, 14$b$ while the signal terminals 60 are inserted into the other small openings 14$_1$ to 14$_8$. Note that the locking means to which each connection terminal is affixed is formed in the concave grooves 13$a$, 13$b$ and the small openings 14$a$, 14$b$, 14$_1$ to 14$_8$. FIG. 11 shows the shape of the locking means.

Figure 4:
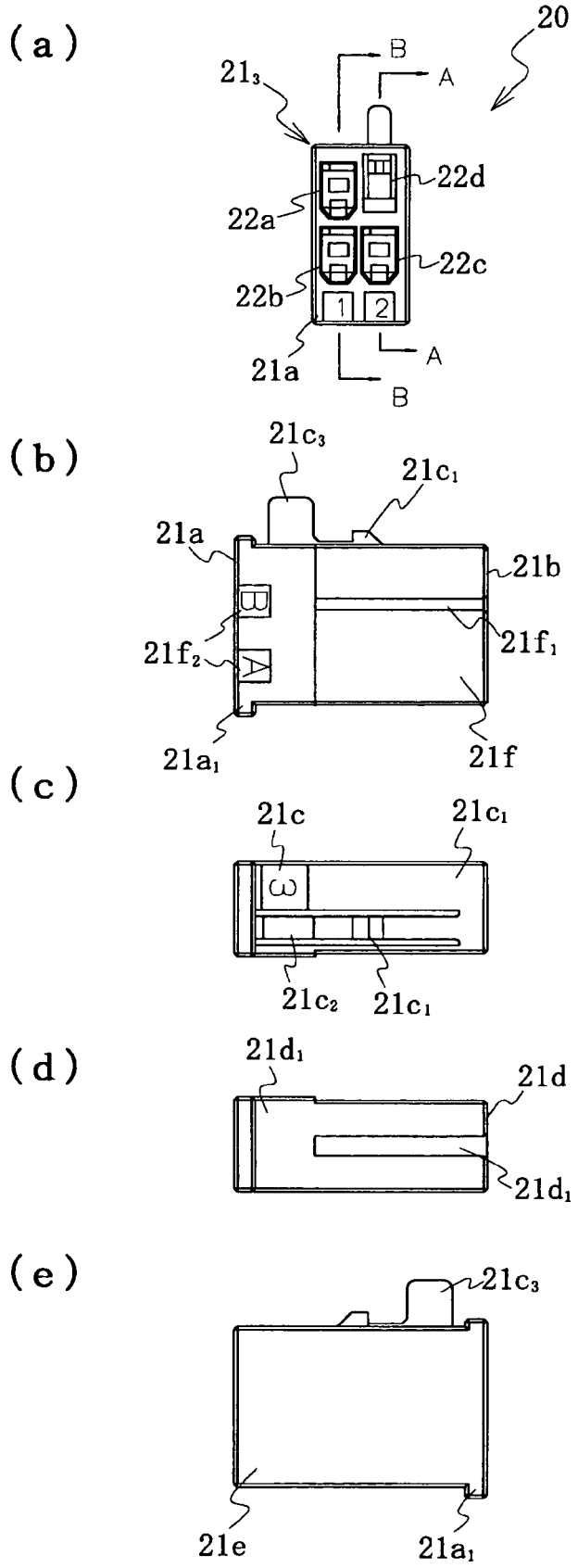
FIG. 4 shows a branch connector, in which FIGS. 4(*a*), (*b*), (*c*), (*d*) and (*e*) respectively show the front, right, plane, bottom and left side views thereof.
Figure 5:
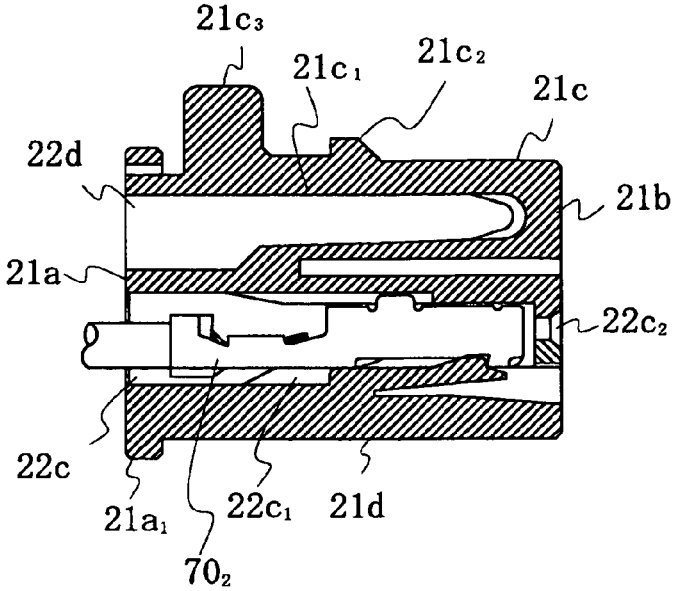
FIG. 5 shows sectional views of the branch connector illustrated in FIG. 4(*a*), in which FIGS. 5(*a*) and (*b*) respectively show the components of A—A and B—B.
Figure 5:
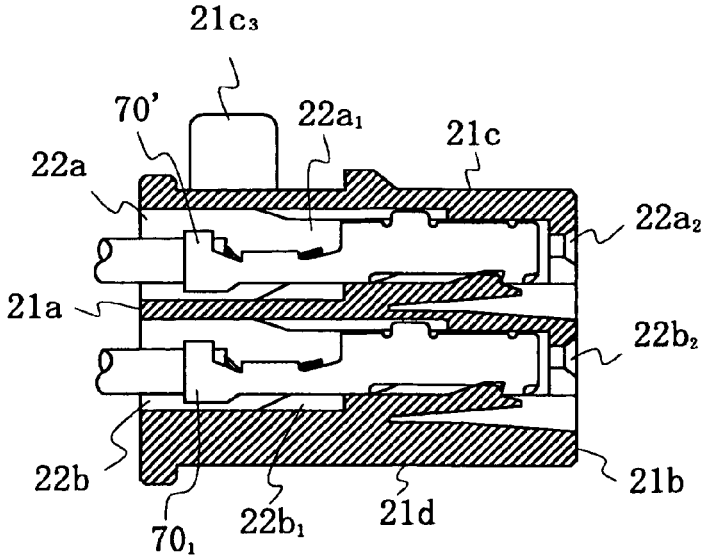

FIG. 4 shows the branch connector, in which FIGS. 4($a$), ($b$), ($c$), ($d$) and ($e$) respectively show the front, right, plane, bottom and left views thereof. FIG. 5 shows sectional views of the branch connector in which FIGS. 5($a$) and ($b$) respectively show the components of A—A and B—B. Note that the sectional views show the portion where the connection terminals are installed.

Because the branch connectors 20 are formed by housings having substantially the same shape, only a description for a housing 21$_3$ will be given, but the distinctions among the housings will be explained.

Made of a synthetic resin material, the housing 21$_3$ shown in FIG. 4 resides in an upright rectangular solid small-box consisting of a front wall 21$a$, a rear wall 21$b$, an upper wall 21$c$, a bottom wall 21$d$, a right wall 21$e$ and a left wall 21$f$.

Reference numeral "3" is marked on the upper wall 21$c$ of the housing as shown in FIG. 4($c$), which shows that it is the branch connector 20$_3$ to be inserted into the opening 11$a_3$ of the main-body connector 11 with branch connectors 20$_1$ to 20$_8$. Additionally, the locking means for engaging the main-body connector 11 is formed on the upper wall 21$c$, and as shown in FIGS. 4($c$) and 5($a$), essentially consists of an elastic piece 21$c_1$, a locking nail 21$c_2$ formed halfway on the elastic piece 21$c_1$, and a protrusion 21$c_3$ formed on the tip of the elastic piece.

Concave grooves 21$f_1$, 21$d_1$ fitted into the alignment ribs 13$_3$, 13'$_3$ formed within the main-body connector opening are formed on the left wall 21$f$ and the bottom wall 21$d$ of the housing 21$_3$. The concave grooves 21$f_1$, 21$d_1$ are formed in corresponding positions in each of the housings 21$_1$ to 21$_8$ of the branch connectors, and function as alignment keys to prevent the branch connectors from being inserted into openings other than their designated openings corresponding to the alignment ribs in the main-body connector openings.

By arbitrarily combining the positions of the concave grooves and notched step on the sidewall and the bottom wall of the housing, a plurality of alignment keys for the branch connectors may be achieved. Further, the notched step on the bottom wall may serve as a concave groove.

The housings 21$_1$ to 21$_8$ of the branch connectors have different positions for the concave grooves and the notched step, which become the alignment positions.

A flange 21$a_1$ with a predetermined width is provided on the periphery of the front wall 21$a$ of the housing 21$_3$, and four openings 22$a$, 22$b$, 22$c$ and 22$d$ are formed on the front wall 21$a$. As shown in FIG. 4 in conjunction with FIGS. 5($a$) and ($b$), the three openings 22$a$, 22$b$, 22$c$ penetrate from the front wall 21$a$ to the rear wall 21$b$ and the remaining opening 22$d$ has a closed rear wall 21$b$. The corresponding exits of through holes 22$a_1$, 22$b_1$, 22$c_1$ at the rear wall 21$d$ narrow into small openings, and the tab contact of each connection terminal is inserted into the openings 22$a_2$, 22$b_2$, 22$c_2$. The locking means for engaging the connection terminals is formed in the through holes 22$a_1$, 22$b_1$, 22$c_1$.

Figure 10:
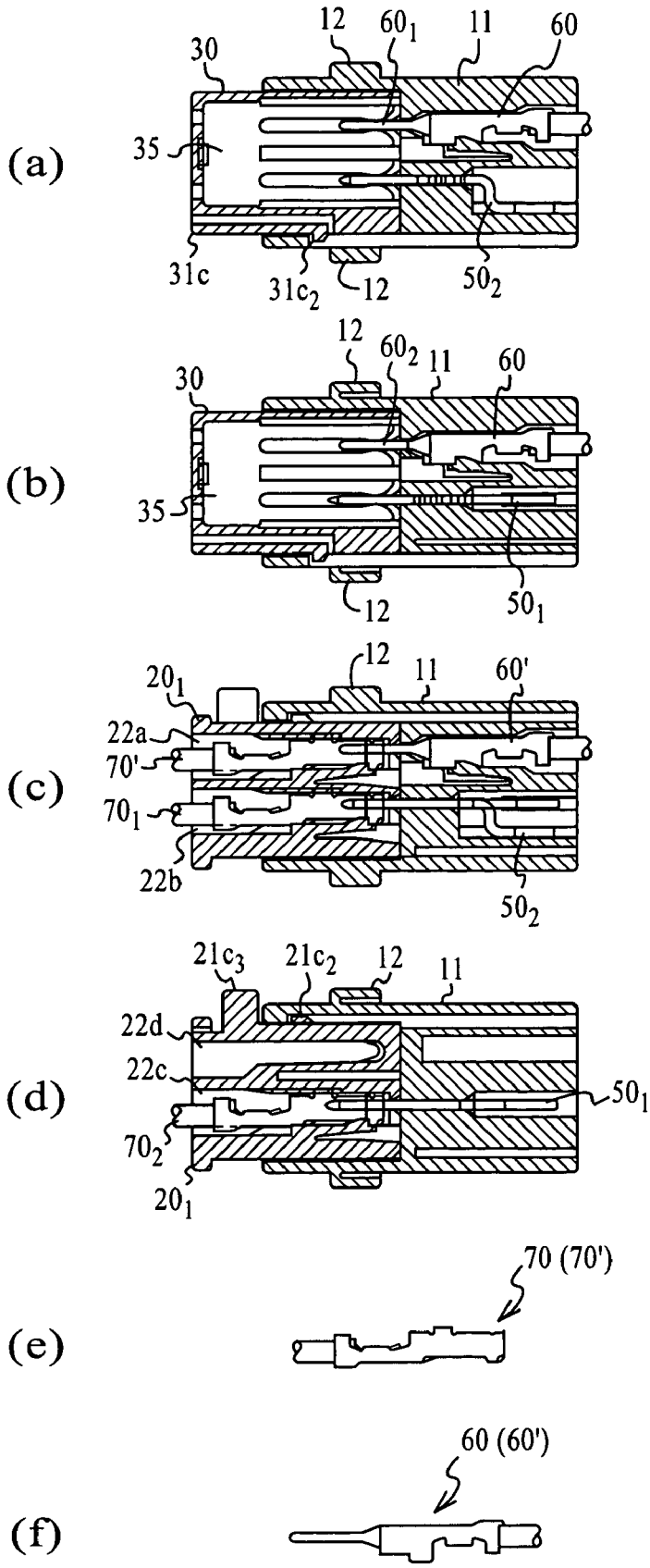
FIG. 10 shows sectional views of the relay connector illustrated in FIG. 9, in which FIGS. 10(*a*), (*b*), (*c*) and (*d*) respectively show the components of A—A, B—B, C—C and D—D of FIG. 9 (*b*), which is the front view of the relay connector.

Of the openings 22$a$, 22$b$, 22$c$, a connection terminal 70' to which the signal line is connected is installed in the opening 22$a$, and power source terminals 70$_1$, 70$_2$ to which the power lines are connected are installed in the openings 22$b$, 22$c$, respectively. As shown in FIG. 10($e$), the connection terminals 70, 70' of the power line and the signal line, female contacts of the same type to which the power line and the signal line are severally connected are used. Note that the connection terminals of the power line and the signal line may be of different types.

Figure 6:
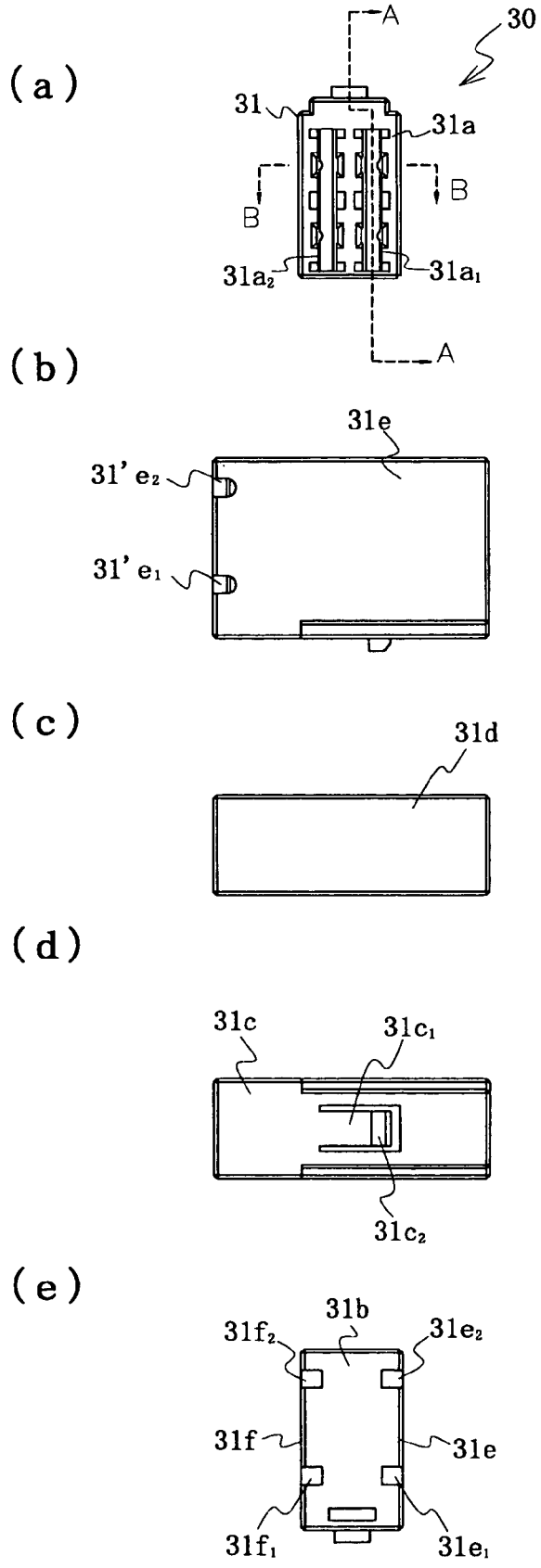
FIG. 6 shows a short-circuit connector, in which FIGS. 6(*a*), (*b*), (*c*), (*d*) and (*e*) respectively show the front, right, plane, bottom and back views thereof.
Figure 7:
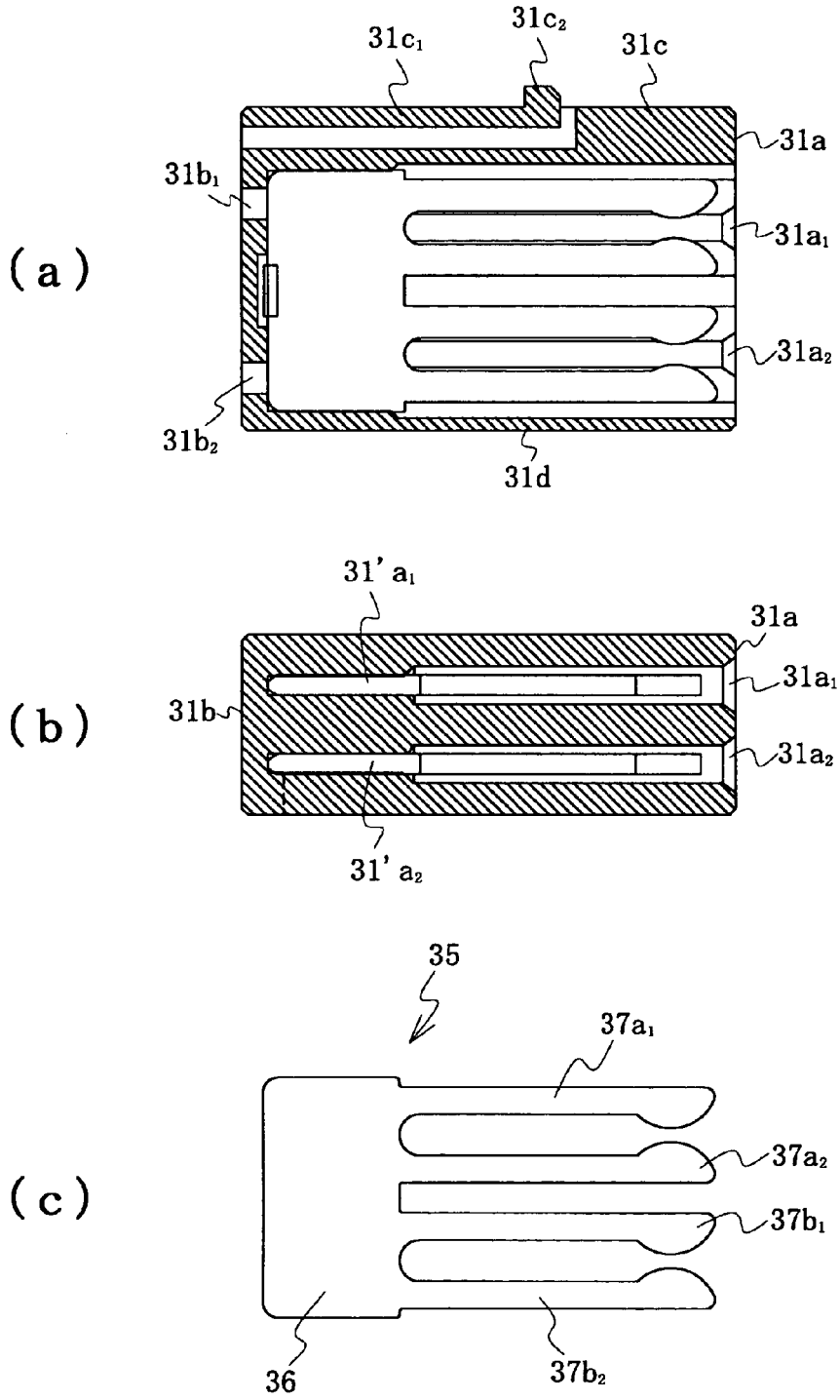
FIG. 7 shows sectional views of the short-circuit connector illustrated in FIG. 6(*a*), in which FIGS. 7(*a*) and (*b*) respectively show the components of A—A and B—B, and FIG. 7(*c*) shows the shape of short-circuit contact.

FIG. 6 shows the short-circuit connector, in which FIGS. 6($a$), ($b$), ($c$), ($d$) and ($e$) respectively show the front, right, plane, bottom and back views thereof. FIG. 7 shows sectional views of the short-circuit connector illustrated in FIG. 6(*a*), in which FIGS. 7(*a*) and (*b*) respectively show the components of A—A and B—B. Note that the sectional views show the state where the short-circuit contacts are installed.

Made of a synthetic resin material, the short-circuit connector 30 consists of a housing 31 in substantially the same upright rectangular solid small-box shape as that of the above-mentioned branch connectors. The housing 31 consists of a front wall 31*a*, a rear wall 31*b*, an upper wall 31*c*, a bottom wall 31*d*, a right wall 31*e* and a left wall 31*f*.

The locking means for engaging the main-body connector 11 is formed on the upper wall 31*c* of the housing 31, and essentially consists of an elastic piece 31$c_1$ and a locking nail 31$c_2$ formed on the tip of the elastic piece.

As shown in FIG. 7(*b*), substantially parallel concave grooves 31$a_1$, 31$a_2$, slightly wider than the thickness of the short-circuit contacts, are formed on the front wall 31*a* of the housing 31 starting from the front wall 31*a* toward the rear wall 31*b*. Each of the concave grooves 31$a_1$, 31$a_2$ is formed so as to become narrower in width from the front wall 31*a* toward the rear wall 31*b* and the portions 31'$a_1$, 31'$a_2$ residing near the rear wall 31*b* shall have such width as to enable the short-circuit contacts to be pressed and fixed.

Two pairs of openings 31$e_1$, 31$e_2$ and 31$f_1$, 31$f_2$, communicating with the rear wall 31*b*, are formed on the rear wall 31*b* corresponding to the concave grooves 31$a_1$, 31$a_2$, respectively. The openings 31'$e_1$, 31'$e_2$ communicating to the outside are also formed starting from the back surface of the concave grooves 31$a_1$, 31$a_2$ toward the sidewalls 31*e*, 31*f*. (Note that the openings are formed on the other sidewall 31*f* as well, but this is not shown in the drawing). The openings function as an observation hole to ensure that the short-circuit contacts accurately fit into the bottom of the concave grooves.

The short-circuit contacts are of the same shape and FIG. 7(*c*) illustrates a representative example.

The short-circuit contact 35, formed of a conductive metal plate having a predetermined thickness, is of such shape that two pairs of fork-shaped contacts, 37$a_1$, 37$a_2$ and 37$b_1$, 37$b_2$ facing each other bristle from a base 36, which has a predetermined width size. The length of the short-circuit contact 35 running from the end portion of the base 36 to the end portion of the contact is slightly shorter than the length of the short-circuit housing 31 in a longitudinal direction. The length of the short-circuit contact 35 is such that when it is housed in the short-circuit housing 31, its tip is slightly withdrawn from the housing front wall.

The two short-circuit contacts 35, 35' (FIG. 7 shows only one example) are installed in the concave grooves 31$a_1$, 31$a_2$, each of which is formed with such shape as to become narrower in width starting from the front wall 31*a* toward the rear wall 31*b*, and the portions 31'$a_1$, 31'$a_2$ near the rear wall 31*b* shall have such width as to enable the short-circuit contact to be pressed and fixed into the grooves. By looking into the openings on the housing rear wall and the openings on each sidewall, one can determine whether each short-circuit contact is properly inserted into the corresponding concave groove.

Figure 8:
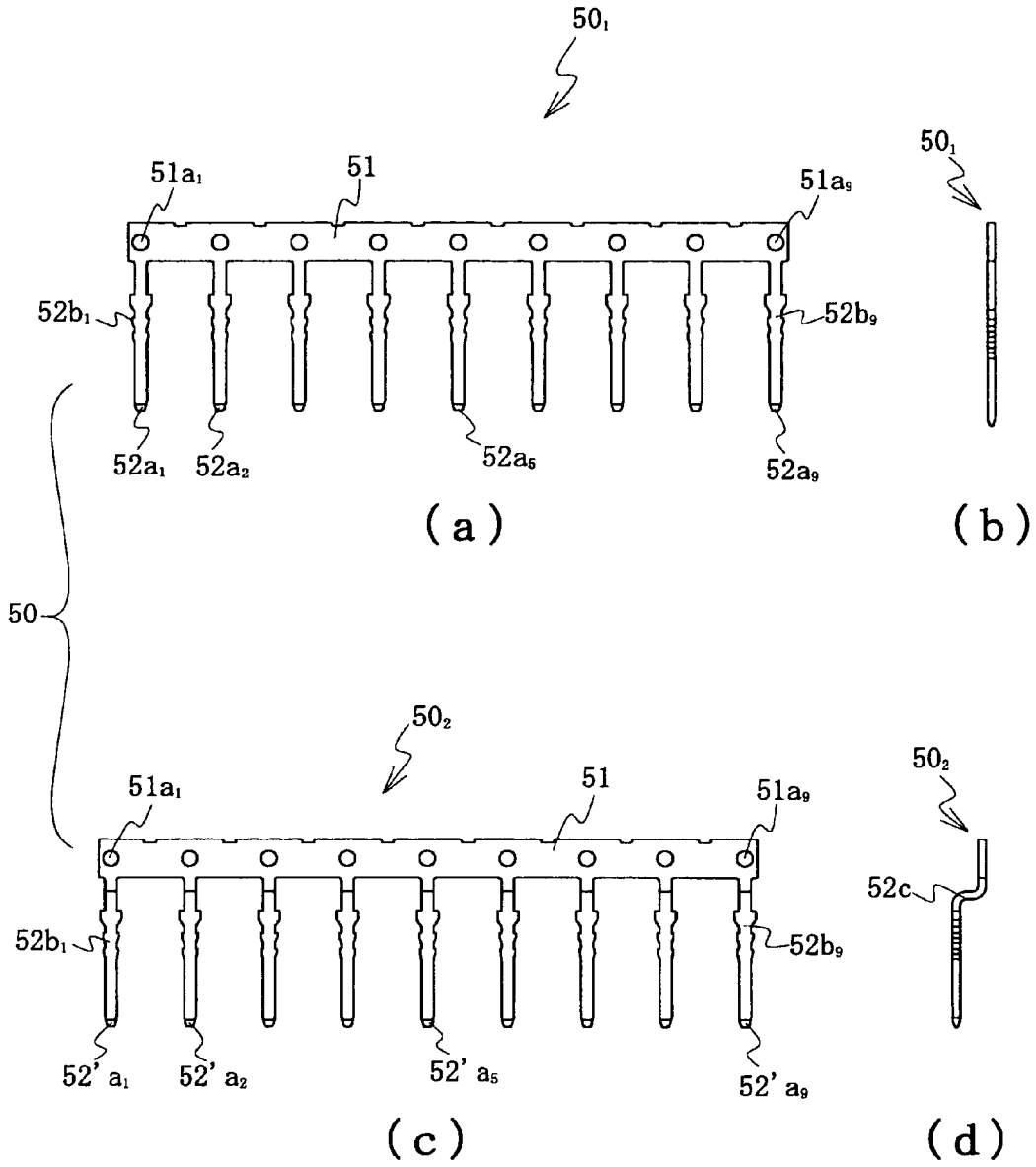
FIG. 8 shows two common contacts, in which FIGS. 8(*a*) and (*b*) respectively show the plane and side views of one common contact, and FIGS. 8(*c*) and (*d*) respectively show the plane and side views of the other common contact.

FIG. 8 shows two common contacts, in which FIGS. 8(*a*) and (*b*) respectively show the plane and side views of one common contact, and FIGS. 8(*c*) and (*d*) respectively show the plane and side views of the other common contact.

The common contacts 50$_1$, 50$_2$, formed of a conductive strip-shaped metal plate by die-cut processing and having substantially the same shape, diverge into plus and minus depending on the polarity of power source.

First, the common features of the common contacts 50$_1$, 50$_2$ are hereafter described.

As shown in FIGS. 8(*a*) and (*c*), the common contacts 50$_1$, 50$_2$ are substantially comb-shaped, and formed in such a manner that a plurality of tab contacts 52$a_1$ to 52$a_9$ for each common contact bristle at equal gaps from a strip-shaped base 51 having a predetermined width, and openings 51$a_1$ to 51$a_9$ are formed at substantially equal gaps on the base 51. The tab contacts are of such length that when they are installed in the main-body connector the tips thereof are close to the front wall of the main-body connector. Furthermore, protrusions 52$b_1$ to 52$b_9$ for locking the main-body connector respectively constitute the half portion of each tab contact.

The common contacts 50$_1$, 50$_2$ differ from each other as follows. As shown in FIG. 8(*b*), each of the tab contacts 52$a_1$ to 52$a_9$ in the common contact 50$_1$ extends straight from the base 51. In contrast, a step is formed in each of the tab contacts 52'$a_1$ to 52'$a_9$ and bent near the base 51 in the common contact 50$_2$. [Refer to FIG. 8(*d*)]. Specifically, each tab contact 52'$a_1$ to 52'$a_9$ is substantially bent at 90 degrees from the base 51 to form the bent portion 52*c*, in the manner that the bent portion 52*c* forms a single step of a stair. Thus, the length of the tab contacts 52'$a_1$ to 52'$a_9$ of the common contact 50$_2$ measured $_{from}$ the base 51 to the tip of each such tab contact is shorter than that of the tab contacts 52$a_1$ to 52$a_9$ of the common contact 50$_1$.

The common contacts 50$_1$, 50$_2$ are pressed and installed into the concave grooves 13*a*, 13*b* in the housing of the main-body connector.

Hereafter, an example of the relay connector assembled using the components described above and a connection circuit example using the said relay connector will be described.

Figure 9:
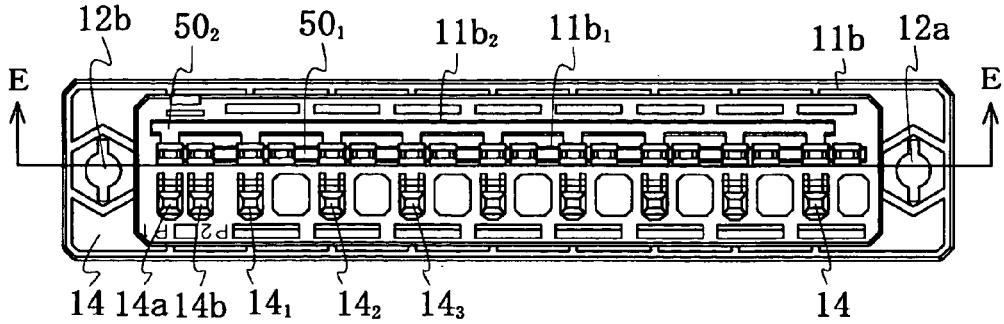
FIG. 9 shows a relay connector in which FIGS. 9(*a*), (*b*) and (*c*) respectively show the plane, front and back views thereof
Figure 9:
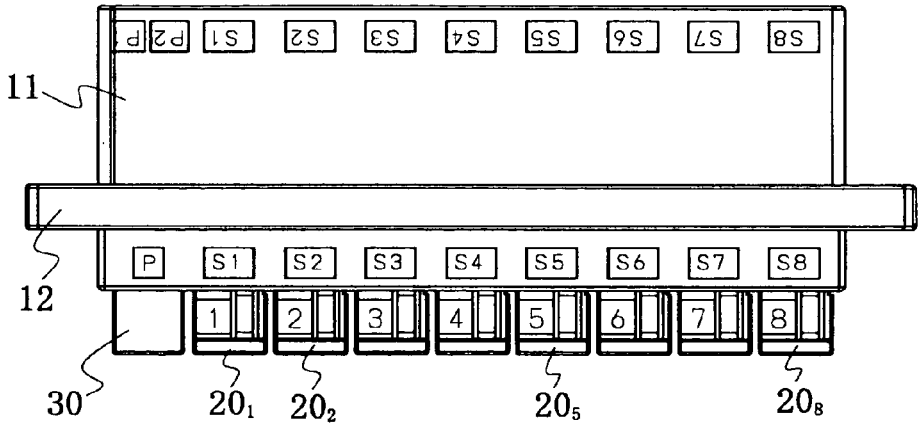
Figure 9:
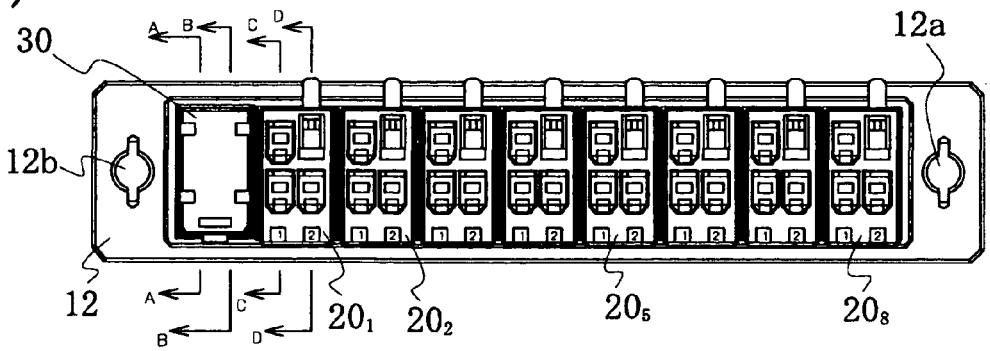

FIG. 9 shows the relay connector assembled using such components, in which FIGS. 9(*a*), (*b*) and(*c*) respectively show the plane, front and back views thereof.

FIG. 10 shows sectional views of the relay connector illustrated in FIG. 9, in which FIGS. 10(*a*), (*b*), (*c*) and (*d*) respectively show the components A—A, B—B, C—C and D—D of FIG. 9(*b*), which is the front view of the relay connector. The sectional views illustrate the manner in which the power source terminals and the signal terminal are connected. Further, FIG. 10(*e*) shows the external perspective view of the power source terminals and the signal terminal of the branch connectors, while FIG. 10(*f*) shows the external perspective view of the power source terminals and the signal terminal of the main-body connector. FIG. 11 is a sectional view at E—E, of FIG. 9(*c*), which is the back view of the relay connector.

Firstly, the two common contacts 50$_1$, 50$_2$ are respectively pressed and installed in the concave grooves 13*a*, 13*b* on the rear wall 11*b* of the main-body connector 11.

When the common contacts 50$_1$, 50$_2$ are pressed and installed in the concave grooves 13*a*, 13*b*, the openings 51$a_1$ to 51$a_9$ having equal gaps formed on the base 51, are positioned to be in alignment with the protrusions (not shown) in the concave grooves 11$b_1$, 11$b_2$. Likewise, the locking protrusions 52$b_1$ to 52$b_9$ are pressed into the concave grooves 11$b_1$, 11$b_2$, respectively and the tab contacts 52$a_1$ to 52$a_9$ and 52'$a_1$ to 52'$a_9$ are affixed to the concave grooves 13*a*, 13*b* respectively.

When the common contacts 50$_1$, 50$_2$ are affixed to the concave grooves 13*a*, 13*b*, the length of each of the tab contacts 52'$a_1$ to 52'$a_9$ of the common contact 50$_2$ measured from the base 51 to the tip of each such tab contact is shorter than that of the tab contacts 52$a_1$ to 52$a_9$ of the common contact 50*i* by reason of the bent portion, so that the tip of each of the tab contacts 52$a_1$ to 52$a_9$ of the common contact 50$_1$ protrudes toward the front wall further, in contrast to each of the tab contacts 52'$a_1$ to 52'$a_9$ of the common contact 50$_2$. (Refer to FIG. 11). Therefore, when the branch connectors 20$_1$ to 20$_8$ are coupled to the tab contacts 52$a_1$ to 52$a_9$ and 52'$a_1$ to 52'$a_9$, there is a time lag in establishing connection between the branch connectors and the tab contacts.

The main-body connector equipped with the common contacts is connected to the substrate connector and a plurality of equipment in the following manner.

The power source terminals 60$_1$, 60$_2$ and a signal terminal 60' are first connected to the tips of the power lines and the signal line which in turn are connected to the substrate connector, and the power source terminals 60$_1$, 60$_2$ and the signal terminal 60' are fitted to the small openings 14*a*, 14*b*, 14$_1$ to 14$_8$ of the main body connector 11. Specifically, the power source terminals 60$_1$, 60$_2$ (marked by reference numerals P1 and P2 in FIG. 3) are inserted into the small openings 14*a*, 14*b* from among the small openings 14*a*, 14*b*, 14$_1$ to 14$_8$, and the signal terminal 60' is inserted into the small openings 14$_1$ to 14$_8$.

When the two power source terminals 6O$_1$, 60$_2$ and the signal terminal 60' are installed, the tab contacts of the common contacts 50$_1$, 50$_2$, the power source terminals 6O$_1$, 60$_2$ and the signal terminal 60' protrude in each of the openings 11$a_0$ to 11$a_8$ on the front wall 11*a* of the main-body connector 11 in such manner that the main-body connector can be coupled with the branch connectors and the short-circuit connector, because the two common contacts 50$_1$, 50$_2$ are already installed at the rear wall 11*b* of the main-body connector 11.

In other words, the tab contacts 52$a_1$, 52'$a_1$ of each common contact 50$_1$, 50$_2$ and the tab contacts of each power source terminal 60$_1$, 60$_2$, that is, four tab contacts protrude in the opening 11$a_0$.

The common contacts 50$_1$, 50$_2$ and the tab contacts 52$a_1$, 52'$a_1$ are thus arranged in a parallel way in the upper section, and the tab contacts (not shown) of the two power source terminals 60$_1$, 60$_2$ are similarly arranged in the lower section.

Further, the main-body connector equipped with the power source terminals and the signal terminals is connected to a plurality of equipment as follows.

The short-circuit connector 30 is first attached to the main-body connector 11. When the short-circuit connector 30 is installed in the opening 11$a_0$ in which the tab contacts are arranged as described above, the contacts 37$a_1$, 37$a_2$ (not shown) of one short-circuit contact 35 are respectively connected to each tab contact 52$a_1$, 52'$a_1$, and the other contacts 37$b_1$, 37$b_2$ are connected to each such tab contact. Other short-circuit contacts are coupled in the same manner. In this way, the tab contacts 52$a_1$, 52'$a_1$ of the common contact 50$_1$, 50$_2$ and the power source terminals 60$_1$, 60$_2$ are electrically connected. The short-circuit connector 30 can be removed from the opening 11$a_0$ of the main-body connector 11 by pushing the locking nail 31$c_2$ shown in FIG. 7 by means of a device.

Subsequently, the power source terminals 60$_1$, 60$_2$ and the signal terminal 60', which are severally connected to the tips of the power lines and the signal line connected to the various equipment, are thus connected to the branch connectors 20$_1$ to 20$_8$, and the branch connectors are then respectively inserted into the openings 11$a_1$ to 11$a_8$ on the front wall of the main-body connector.

Because the branch connectors 20$_1$ to 20$_8$ and the short-circuit connector 30 are provided with alignment keys mentioned above, the possibility of erroneously inserting them into openings other than their intended location is eliminated. Further, because the main-body connector and the branch connectors are marked with reference numbers for identification purposes, the connectors can be easily inserted into the pertinent openings. In addition, the locking means serves to affix the short-circuit connector 30 and the branch connectors 20$_1$ to 20$_8$ in the openings 11$a_1$ to 11$a_8$. Furthermore, the branch connectors 20$_1$ to 20$_8$ can be easily removed from the main-body connector by pushing the protrusion 21$c_3$ of the branch connector housing 21$_3$ (illustrated in FIG. 4) downward. The other branch connectors can be removed from the main-body connector through the same method.

As described above, the present invention provides for a relay connection circuit with a reduced number of connection lines leading out from one side of the relay connector, facilitating the circuit design of peripheral devices and a relay connection circuit that can be disconnected/connected by attaching/detaching the short-circuit connector.

Furthermore, the present invention provides for a relay connector with a reduced number of connection lines leading out from one side thereof.

What is claimed is:

1. A relay connection circuit, comprising:

a relay connector having common contacts in a housing disposed between a substrate connector installed in the main equipment and the like and a number of sub-equipment, the relay connector and the sub-equipment being connected by first and second connection lines of each sub-equipment, where the first connection lines are severally connected to the common contacts, and the common contacts and the second connection lines are connected to the substrate connector; and a short-circuit connector comprising a conductive metal plate and two pairs of fork-shaped contacts, said short-circuit connector being connected to said relay connector for providing a constant electrical connection between said common contacts and said substrate connector.

2. A relay connector, comprising:

a plurality of branch connectors each equipped with first and second connection terminals; and a main-body connector where common contacts are disposed in a housing, wherein a third connection terminal connected to the common contacts and a fourth connection terminal connected to the second connection terminals are installed in the housing, the common contacts and the third connection terminal are connected, the common contacts are connected to the first connection terminal of each branch connector and the second connection terminals are connected to the fourth connection terminal when coupling the main-body connector and the branch connectors, and said common contacts are connected by said third connection terminal and a short-circuit connectors, wherein said short-circuit connector comprises a conductive metal plate and two pairs of fork-shaped contacts and provides a constant electrical connection between said common contacts and said third connector terminal.

3. The relay connector according to claim 2, wherein said common contacts are substantially in comb-shape form where several tab contacts bristle from a strip-shaped base with a predetermined pitch.

4. The relay connector according to claim 2, wherein said common contacts reside in the said main-body connector housing substantially parallel to the longitudinal direction of said main-body connector.

5. The relay connector according to claim 4, wherein said common contacts comprise a pair of common contacts having the same shape, in which one common contact is bent from the base, the tab contacts tips of one common contact being shorter than the tab contacts of the other common contact when the common contacts reside in said main-body connector housing.

6. The relay connector according to claim 2, wherein said common contacts are substantially in comb-shape form where several tab contacts bristle from a strip-shaped base with a predetermined pitch, and several common contacts reside in said main-body connector housing substantially parallel to the longitudinal direction of said main-body connector.

7. The relay connector according to claim 6, wherein said common contacts comprise a pair of common contacts having the same shape, in which one common contact is bent from the base, the tab contacts tips of one common contact being shorter than the tab contacts of the other common contact when the common contacts reside in said main-body connector housing.

8. The relay connector according to claim 2, wherein said short-circuit connector is installed freely so as to be detachable from the front wall of the main-body connector.

9. The relay connector according to claim 7, wherein said common contacts are substantially in comb-shape form where several tab contacts bristle from a strip-shaped base with a predetermined pitch.

10. The relay connector according to claim 7, wherein said common contacts reside in the said main-body connector housing substantially parallel to the longitudinal direction of said main-body connector.

11. The relay connector according to claim 10, wherein said common contacts comprise a pair of common contacts having the same shape, in which one common contact is bent from the base, the tab contacts tips of one common contact being shorter than the tab contacts of the other common contact when the common contacts reside in said main-body connector housing.

12. The relay connector according to claim 7, wherein said common contacts are substantially in comb-shape form where several tab contacts bristle from a strip-shaped base with a predetermined pitch, and several common contacts reside in the said main-body connector housing substantially parallel to the longitudinal direction of said main-body connector.

13. The relay connector according to claim 12, wherein said common contacts comprise a pair of common contacts having the same shape, in which one common contact is bent from the base, the tab contacts tips of one common contact being shorter than the tab contacts of the other common contact when the common contacts reside in said main-body connector housing.

* * * * *